US006219938B1

(12) United States Patent
Anderson

(10) Patent No.: US 6,219,938 B1
(45) Date of Patent: Apr. 24, 2001

(54) REMOVABLE FABRIC COVERING FOR A SHOE

(76) Inventor: Alexandra Anderson, 2852 Channel Bay Dr., Las Vegas, NV (US) 89128

( * ) Notice: Subject to any disclaimer, the term of this patent is extended or adjusted under 35 U.S.C. 154(b) by 0 days.

(21) Appl. No.: 09/157,179

(22) Filed: Sep. 19, 1998

Related U.S. Application Data

(63) Continuation-in-part of application No. 08/911,726, filed on Aug. 15, 1997, now abandoned.

(51) Int. Cl.[7] ..... A43B 3/16; A43B 23/00
(52) U.S. Cl. ..... 36/7.1 R; 36/57
(58) Field of Search ..... 36/57, 58, 7.1 R, 36/135, 136, 7.5, 53

(56) References Cited

U.S. PATENT DOCUMENTS

| | | | |
|---|---|---|---|
| 136,649 | * | 3/1873 | Goldthwait . |
| 296,314 | | 4/1884 | Carter . |
| 591,888 | | 10/1897 | Seay . |
| 1,778,413 | * | 10/1930 | Ballou . |
| 2,193,355 | | 3/1940 | Gilbert . |
| 2,299,316 | | 10/1942 | Fein . |
| 2,799,951 | | 7/1957 | Rogers . |
| 3,009,269 | | 11/1961 | Folk . |
| 3,076,215 | | 2/1963 | Orlando . |
| 3,308,562 | | 3/1967 | Zimmon . |
| 3,808,712 | * | 5/1974 | Elliot . |
| 3,898,750 | | 8/1975 | Epstein . |
| 3,973,337 | * | 8/1976 | Ecton . |
| 4,023,281 | | 5/1977 | Terry . |
| 4,597,198 | * | 7/1986 | Schweitzer . |
| 4,610,042 | | 9/1986 | Theodorsen . |
| 4,610,102 | | 9/1986 | Hill . |
| 4,616,428 | | 10/1986 | Leger . |
| 4,651,354 | | 3/1987 | Petrey . |
| 4,823,426 | * | 4/1989 | Bragga . |
| 4,825,564 | | 5/1989 | Sorce . |
| 4,976,050 | | 12/1990 | Houghteling . |
| 5,337,491 | | 8/1994 | Mascotte . |
| 5,535,529 | | 7/1996 | Panteah . |
| 5,575,014 | | 11/1996 | Kane et al. . |

FOREIGN PATENT DOCUMENTS

| | | | |
|---|---|---|---|
| 23312 | | 2/1936 | (AU) . |
| 539902 | | 4/1957 | (CA) . |
| 1165749 | | 10/1958 | (FR) . |
| 5683 | * | 12/1901 | (GB) . |
| 289608 | * | 5/1928 | (GB) . |

* cited by examiner

*Primary Examiner*—Ted Kavanaugh
(74) *Attorney, Agent, or Firm*—Philip J. Anderson; Quirk & Tratos

(57) ABSTRACT

A cloth retention strip is folded to have two plies. The retention strip is sewn onto an oval shaped cloth panel along a border thereof. A draw string is retained between the plies. The draw string is operable to draw the panel over the toe and around the heel of a shoe that is worn by a user. The draw string may be held in place by fastening two cloth tabs on the draw string to each other or to a third fastener on the shoe covering. A non-skid material may be sewn, baked, or deposited onto the outside surface to provide a non-skid surface.

6 Claims, 4 Drawing Sheets

REMOVABLE FABRIC COVERING FOR A SHOE

RELATED APPLICATION DATA

This application is a continuation-in-part of U.S. patent application Ser. No. 08/911,726 filed Aug. 15, 1997, now abandoned.

1. Field of the Invention

This invention relates generally to protective clothing and, more specifically, to a covering for a shoe.

BACKGROUND OF THE INVENTION

2. Description of the Prior Art

One of a plethora of examples of a place where a covering over the bottom of a shoe is particularly desirable is in a hospital. The shoe covering could prevent an accumulation of dirt on the bottom of the shoe resulting in a spread of microbes among a population that has a low resistance to disease. The shoe covering is additionally desirable in many types of industrial establishments, such as a clean room of a semiconductor factory.

Similarly, when a homeowner has a workman install a carpet in a home, it is preferable that the carpet be clean at least prior to either the homeowner or a member of the homeowner's family setting foot on the carpet. Accordingly, it is desirable that the workman wear the shoe covering.

Likewise, when a person enters an automobile, dirt from the person's shoes is usually deposited upon the floor of the automobile. The deposition of the dirt can be prevented by the person wearing the shoe covering prior to entering the automobile.

One of the typical problems of the shoe coverings in the prior art is that they do not fit a multiplicity of sizes of shoes. That is, when the shoe covering fits a small shoe of a female, it usually does not fit a large shoe of a workman. Thus, it is desirable that a shoe covering be able to fit a range of shoe sizes.

Furthermore, it is desirable that the shoe covering be simple and inexpensive to manufacture. For example, U.S. Pat. No. 4,023,281 discloses a covering that fits almost all sizes of shoes. However, the '281 covering includes elastic yarn and requires a considerable amount of stitching. Therefore, the '281 covering is undesirably complex and may be expensive to manufacture.

There is a need for a shoe covering that fits a multiplicity of sizes of shoes and is simple and inexpensive to manufacture.

SUMMARY OF THE INVENTION

An object of the present invention is to provide a shoe covering that fits a multiplicity of sizes of shoes.

Another object of the invention is to provide a shoe covering that is inexpensive to manufacture and easy to construct.

According to the present invention, a cloth retention strip is folded to form two plies. The retention strip is fixedly disposed along the border of a cloth panel. A draw string that is retained between the plies is operable to draw the panel over the toe and around the heel of a shoe that is placed upon the panel.

The invention provides a shoe covering that fits either a left shoe or a right shoe. The invention includes a draw string that is operable to cause the size of the shoe covering to vary to fit a multiplicity of sizes of shoes. Various covering sizes may be used to accommodate a wider variety of shoe sizes such as one size for smaller shoes and another size for larger shoes. The shoe covering is easily used and is washable to permit reuse. A rubberized pad may be connected to an outside of the shoe covering to provide a non-skid surface. In an alternate embodiment, rubber or similar non-skid substance could be baked or deposited on the outside of the shoe covering in a dotted, crisscrossed, or solid pattern to provide a non-skid surface.

Other objects, features, and advantages of the invention should be apparent from the following description of the preferred embodiment as illustrated in the accompanying drawing.

DESCRIPTION OF THE PREFERRED EMBODIMENT

Figure 1:
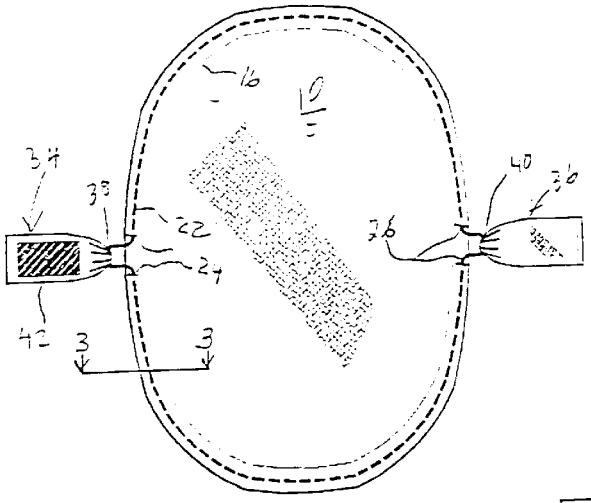
FIG. 1 is a plan view of an inside surface of a panel in the preferred embodiment of the present invention.
Figure 2:
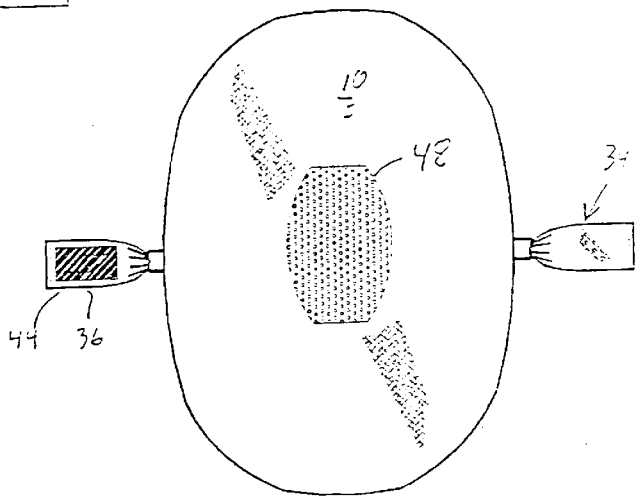
FIG. 2 is a plan view of an outside surface of the panel in the embodiment of FIG. 1.
Figure 3:
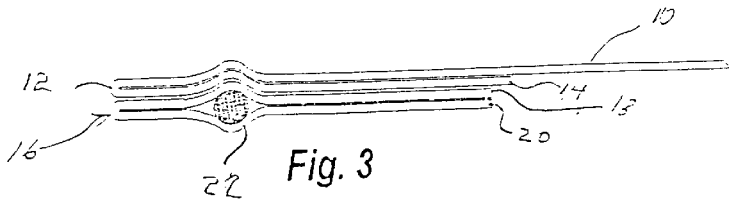
FIG. 3 is a section of FIG. 1 taken along the line 3—3.

As shown in FIGS. 1–3, a shoe covering includes a substantially flat, flexible cloth panel 10 in the general shape of an oval. The panel 10 is folded along a border 12 (FIG. 3) to form a panel ply 14.

A cloth retention strip 16 is comprised of an inner ply 18 and an outer ply 20. Means for fixedly connecting the panel 10 to the retention strip 16, such as a seam 32, are provided. In the preferred embodiment, the panel 10 and the strip 16 are sewn together along the border 12 in a manner described hereinafter.

A draw string 22 is carried between the plies 18, 20. The device includes means for providing access to the draw string 22, such as a pair of access slits 24, 26. As explained hereinafter, the draw string 22 is used to draw the panel 10 over the toe and around the heel of a shoe that is worn by a user.

Figure 4:
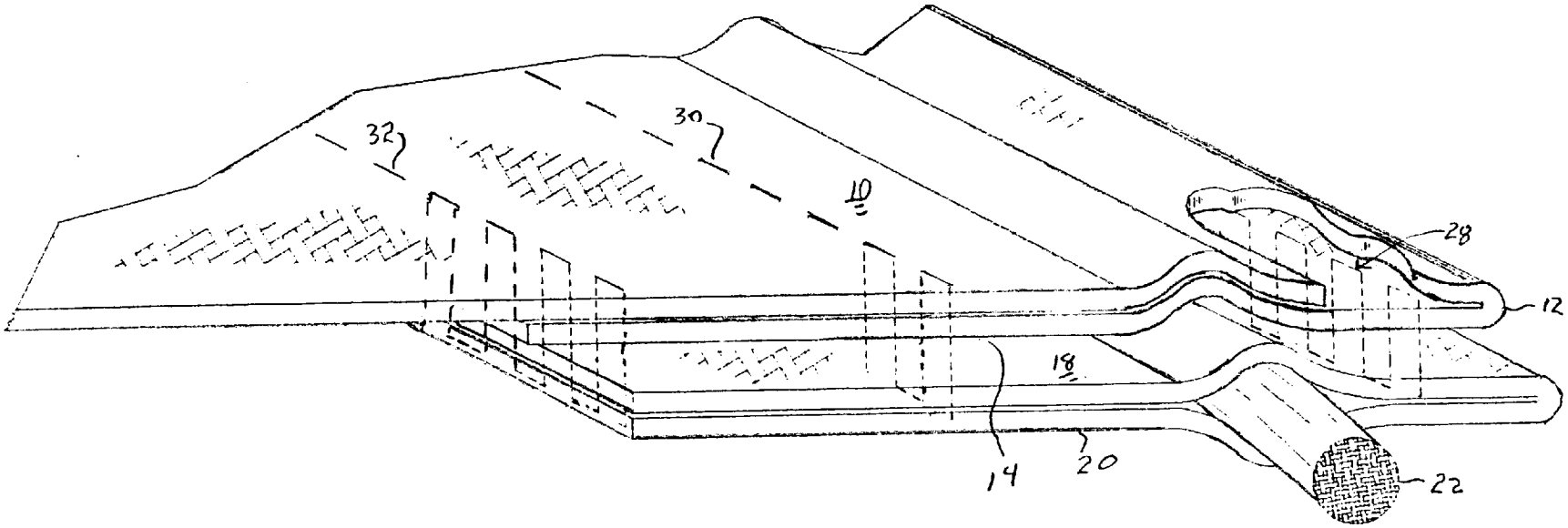
FIG. 4 is an exploded perspective view, with parts broken away, of a portion of the seams in the embodiment of FIG. 1.

As shown in FIG. 4, the plies 14, 18 are sewn together by a seam 28 that is substantially parallel to the border 12. Therefore, the seam 28 is in the shape of an oval. It should be understood that the seam 28 is not visible to a user because it is not directly connected to either the panel 10 or the ply 20.

Means for retaining the draw string 22 between the strip plies 18, 20, such as a retention seam 30, is provided. In the preferred embodiment, the panel 10 and the plies 14, 18, 20 are all sewn together by a retention seam 30 that is substantially parallel to the border 12. Because the plies 18, 20 are sewn together by the seam 30, the draw string 22 is retained by the seam 30 between the plies 18, 20. Like the seam 28, the seam 30 is in the shape of an oval that is substantially parallel to the border 12.

The plies 14, 18, 20 are sewn to the panel 10 by a seam 32, whereby ends of the plies 14, 18, 20 are sewn together. The seam 32 reduces stress on the seam 30.

A pair of cloth tabs 34, 36 (FIGS. 1 and 2) have loops 38, 40, respectively, at ends thereof. The draw string 22 passes through the loops 38, 40. Preferably, ends (not shown) of draw string 22 are tied together and sewn into the interior of the loop 38.

In one embodiment, the tabs 34, 36 have mating fastener elements, such as mating fastener pads 42, 44 of a hook and pile fastener such as Velcro™, sewn onto one side.

Figure 5:
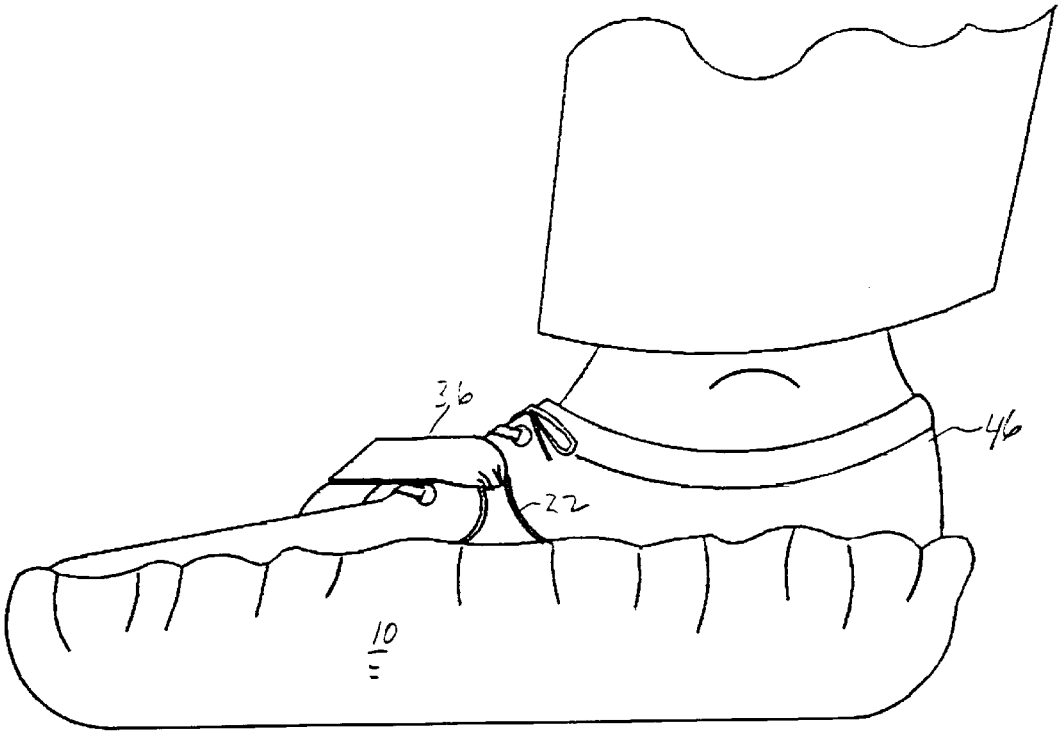
FIG. 5 is a side elevation of the embodiment of FIG. 1 being worn on a shoe.
Figure 6:
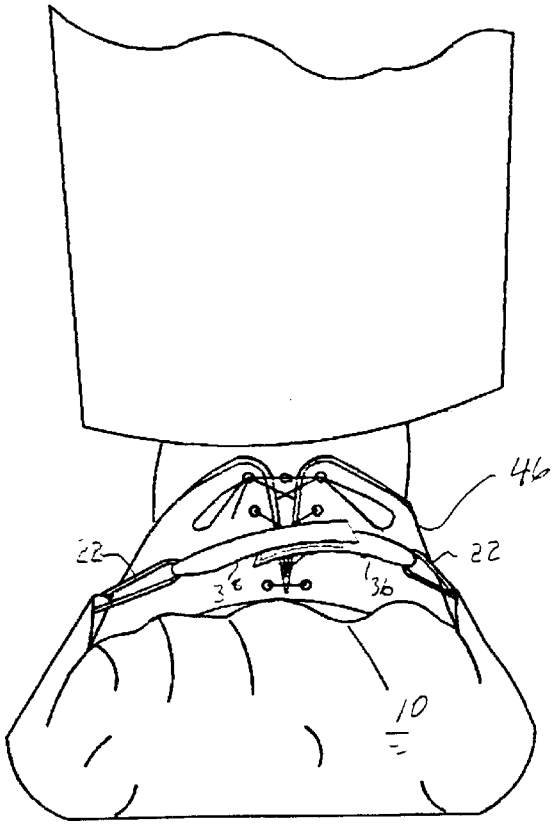
FIG. 6 is a front elevation of the embodiment of FIG. 1 being worn on a shoe.

As shown in FIGS. 5 and 6, in this embodiment, when a user's shoe 46 is upon the inside surface of the panel 10, the user may pull on the draw string 22 to cause the panel 10 to fit over the toe and around the heel of the shoe 46. Additionally, the fastener pads 42, 44 may be used to connect the tabs 34, 36 together and thereby maintain the fit over the toe and around the heel.

Figure 7:
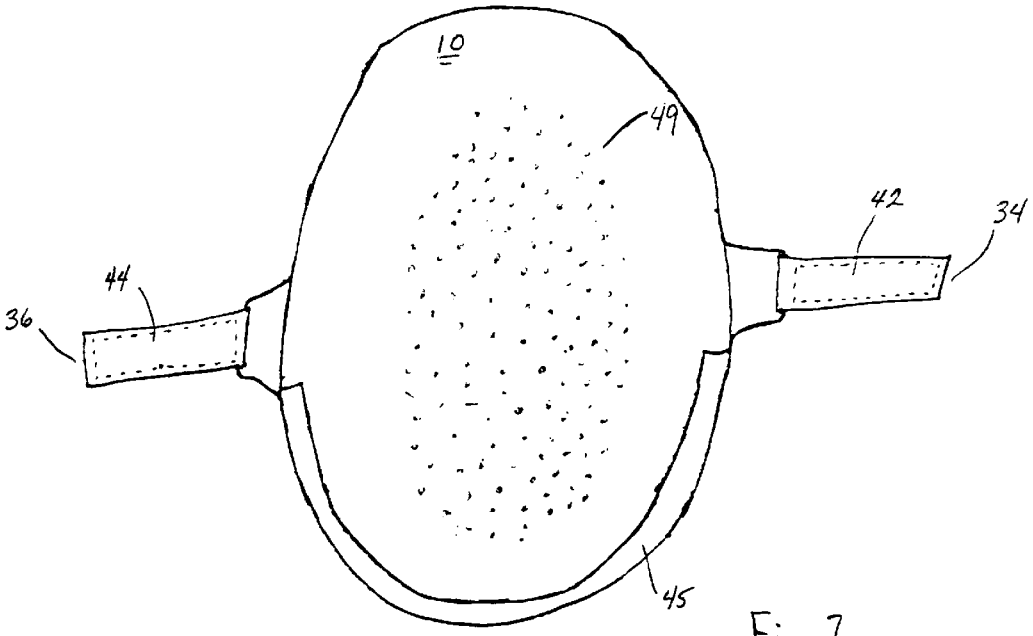
FIG. 7 is a plan view of an outside surface of the panel in an alternate embodiment.

In an alternate embodiment, shown in FIG. 7, one fastener element, such as hook fastener pads 42, 44 of a hook and pile fastener such as Velcro™, is attached onto one side of each tab 34, 36. The mating fastener element, such as a pile fastener pad 45, is attached to the outside surface of the panel 10.

Figure 8:
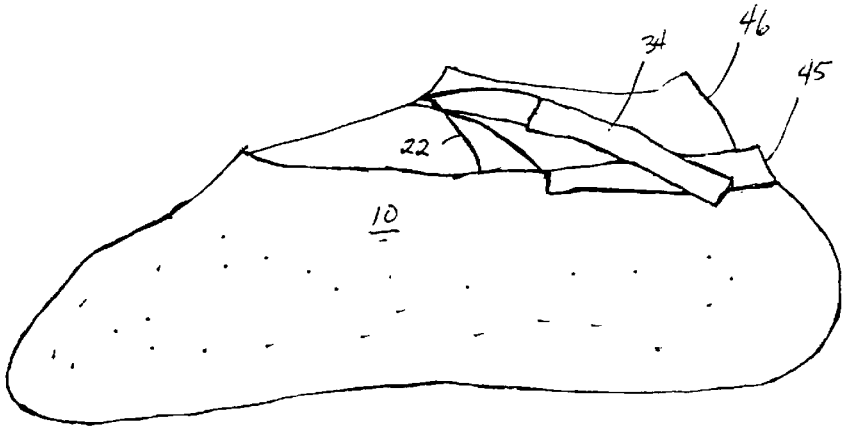
FIG. 8 is a side elevation of the embodiment of FIG. 7 being worn on a shoe.

As shown in FIG. 8, in this embodiment, the panel 10 is secured by pulling the draw string 22 tight to fit the panel 10 over the toe and around the heel of the shoe 46. To maintain the fit, the tabs 34, 36 may be pulled in opposite directions across the front top of the user's foot, thereby crossing the draw string 22 at the front top of the user's foot. The hook fastener pads 42, 44 attached to the tabs 34, 36 may then be coupled to the pile fastener pad 45 on the outside of the panel 10 which is drawn around the user's heel when the draw string 22 is tightened. Because the tabs 34, 36 are crossed at the front top of the user's foot, the hook fastener pad 44 on the tab 36 from the right side of the user's foot is coupled to the pile fastener pad 45 near the left side of the heel and the hook fastener pad 42 on the tab 34 from the left side of the user's foot is coupled to the pile fastener pad 45 near the right side of the user's heel.

Preferably, a rubberized pad 48 (FIG. 2) is sewn onto the outside surface of the panel 10. The pad 48 provides a non-skid surface that reduces a danger of the user slipping on a floor with a smooth surface. In an alternate embodiment, shown in FIG. 7, a rubber or other non-skid material 49 is baked or deposited directly onto the outside surface of the panel 10. The non-skid material 49 may be arranged in a variety of patterns including dots, cris-crossed lines, or solid patches. The panel 10 is preferably made from a water repellant material such as Subplex®.

While the invention has been particularly shown and described with reference to a preferred embodiment thereof, it should be understood by those skilled in the art that changes in form and detail may be made therein without departing from the spirit and scope of the invention.

I claim:

1. A removable cover for a shoe comprising:

a round, flat fabric panel of a size to envelop a shoe and including at its perimeter a hem, said hem interrupted at locations on said perimeter;

a drawstring disposed in the hem;

tabs connected to the drawstring at said interrupted locations, each tab including one of the hook or pile strips of a hook and pile fastener; and said panel including at its perimeter a pad having the other of said hook and pile fastener, whereby placing a shoe on the panel and pulling the drawstrings draws the hem to the foot and urges the panel to envelop the shoe and connecting the tabs by the hook and pile components to the pad retains the cover over the shoe and disconnecting the hook and pile components disengages the panel from the show for removal thereof.

2. The cover of claim 1 wherein said panel is ovoid in shape.

3. The cover of claim 1 wherein said pad is disposed to be positioned at the heel of shoe when the panel is constricted about the shoe.

4. The cover of claim 1 further including non-skid material disposed on said panel to provide traction when the cover is on the shoe.

5. A removable fabric cover for a shoe comprising:

a flat, ovoid, fabric panel having dimensions to envelop a shoe, said panel including proximate it perimeter connected plies to retain a drawstring;

tabs connected to the drawstring at spaced locations about the perimeter of the panel, each tab including one of the hook or pile strips of a hook and pile fastener;

said panel including at its perimeter a pad having the other of said hook and pile fastener, whereby placing a shoe on the panel and pulling the drawstrings draws the panel perimeter to the foot to envelop the shoe and connecting the tabs by the hook and pile components to the pad retains the cover over the shoe and disconnecting the hook and pile components disengages the panel from the show for removal thereof.

6. The cover of claim 5 further including non-skid material disposed on said panel to provide traction when the cover is on the shoe.

* * * * *